US005630765A

United States Patent [19]

Moore

[11] Patent Number: 5,630,765

[45] Date of Patent: May 20, 1997

[54] GOLF CLUB

[76] Inventor: James T. Moore, 2003 Foxcroft Dr., LaGrange, Ga. 30240

[21] Appl. No.: 639,622

[22] Filed: Apr. 29, 1996

[51] Int. Cl.[6] ..... A63B 53/04

[52] U.S. Cl. ..... 473/252; 473/340; 473/341; 473/350

[58] Field of Search ..... 473/324, 325, 473/326, 327, 328, 329, 330, 331, 332, 333, 334, 335, 336, 337, 338, 339, 340, 341, 342, 344, 345, 346–350, 282, 226, 227–256; D21/217, 218, 219

[56] References Cited

U.S. PATENT DOCUMENTS

| | | | |
|---|---|---|---|
| D. 161,790 | 1/1951 | Sappington | 473/324 |
| D. 234,960 | 4/1975 | Swash | 473/340 |
| 1,518,316 | 12/1924 | Ellingham | 473/337 |
| 1,592,463 | 7/1926 | Marker | 473/342 |
| 3,143,349 | 8/1964 | MacIntyre | 473/338 |
| 3,516,674 | 6/1970 | Scarborough | 473/335 |
| 4,580,784 | 4/1986 | Brill | 473/286 |
| 4,655,459 | 4/1987 | Antonious | 473/341 |
| 4,681,321 | 7/1987 | Chen | 473/332 |
| 5,058,895 | 10/1991 | Igarashi | 473/341 |

OTHER PUBLICATIONS

"Austad's", Catalog, Oct. 1993, p. 18, Advertisement for AccuTech Sniper.

*Primary Examiner*—Sebastiano Passaniti

*Attorney, Agent, or Firm*—Watson Cole Stevens Davis, P.L.L.C.

[57] ABSTRACT

A putter as disclosed which has a multi-faceted sole portion for facilitating accurate positionment of the club with respect to the ground and has a weight distribution with the weight concentrated in the center near the ball striking face decreasing rearwardly and having recesses of reduced weight adjacent the central portion. Outboard weighted portions balance the club and reduce the tendency of the club to rotate. The sole has a number of surface portions allowing versatility in putter positionment by the golfer. Visualization aids are provided on the upper surface of the club.

19 Claims, 1 Drawing Sheet

GOLF CLUB

BACKGROUND OF THE INVENTION

This invention relates to golf clubs, and in particular to a face balanced golf putter having a relatively wide putting face and weighted lateral and trailing portions and intermediate open or recessed areas.

Golf club heads are normally designed with a planar ball striking face which is aligned adjacent the center of gravity of the club. It is desirable to strike the ball at a point on the ball striking face which is in alignment with the direction of travel of the center of gravity. Any deviation from the optimum point of contact may cause the head to rotate, thereby reducing the applied force and the accuracy of the putt. The problem has been alleviated somewhat by incorporating internal weights in golf clubs at various locations. Arrangements incorporating additional weight in the club structure result in increased manufacturing costs. It is therefore desirable to provide a club with properly distributed weight which is more readily manufactured and at reduced cost.

SUMMARY OF THE INVENTION

The present invention is based upon the discovery that a golf club may be formed with a club head having relatively dense weighted regions and unweighted recesses which locates the center of gravity of the club at a selected elevated central location and distributes added inertial weight about the center of mass towards the heel and toe in a gradually increasing amount outboard of the center of the club. The club has a laterally extending weighted portion perpendicular to the club face and aligned with the center of mass in the direction of swing. The trailing portion balances the face of the club around the center of gravity and also provides a means for visualizing the optimum impact point on the face of the club. Weighted portions are positioned outboard of the club, and intermediate recess areas further balance the club. Visualization is enhanced by employment of an aiming spot and lines embossed in the top surface of the club.

In a particular embodiment, the invention is a golf club putter comprising a body having a heel portion and a toe portion, a striking face extending from the heel portion to the toe portion and a shaft attachment point adjacent the heel portion. The club has a pair of recesses formed therein along lateral sides of the center of the club extending rearwardly in a direction perpendicular to the face of the club head. The club has relatively dense weighted regions including a transverse portion in the front including the club face and an intersecting trailing central portion extending rearwardly of the face. Lateral weights are positioned outboard of the recesses and extend rearwardly. The club has an elevated center of mass located within the central portion where the transverse and trailing portions intersect. The mass of the weight of the club is distributed such that it decreases in the direction extending transversely and laterally from the center of mass. The major portion in the actual mass of the club extends in a lateral direction and is concentrated around the center of mass above a central horizontal plane of the club. The weight distribution causes the club to resist rotation when the ball strikes the club near the center of mass. The outboard weighted portions likewise reduce the tendency of the club to rotate. The elevation of the mass causes the ball to roll in a more consistent manner. At the same time, the weighted trailing portion of the club provides a visual indication of the location of the center of mass in the form of embossed lines. Rotation of the club is minimized when the ball is struck within the inboard boundaries of the lines.

Figure 1:
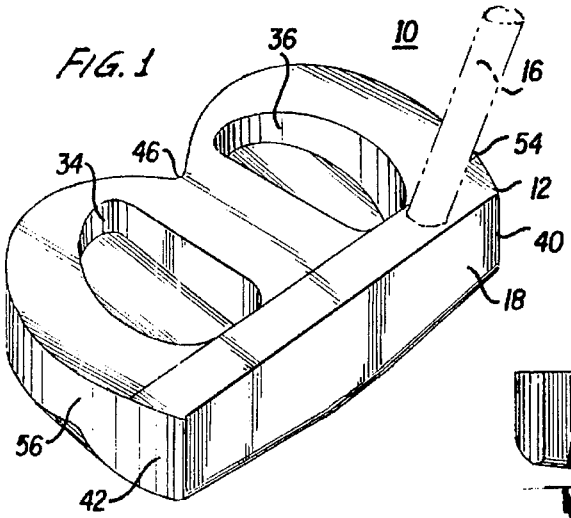
FIG. 1 is a perspective view of a golf putter according to the present invention shown with a shaft in phantom.
Figure 2:
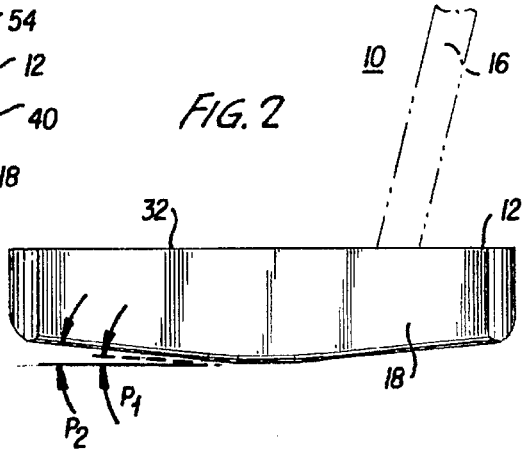
FIG. 2 is a front elevation of the golf putter shown in FIG. 1.
Figure 3:
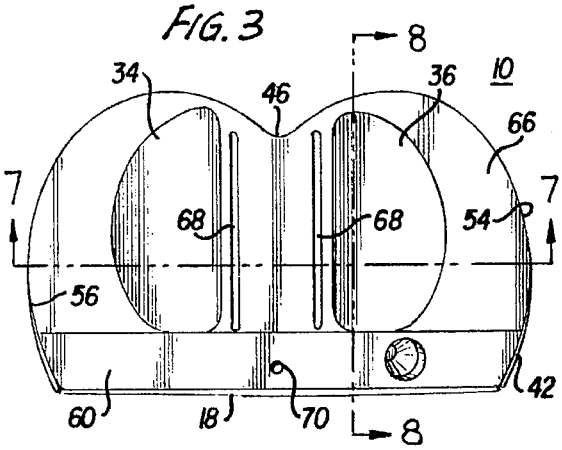
FIG. 3 is a top plan view of the golf putter.
Figure 7:
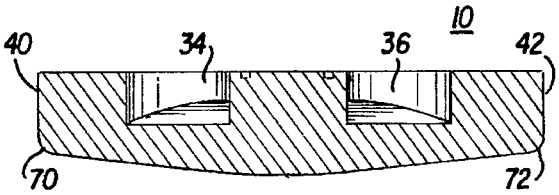
FIG. 7 is a cross-section taken along lines 7—7 of FIG. 3.

The drawings are generally to scale.

DESCRIPTION OF THE INVENTION

The invention is directed to a golf club as illustrated in FIGS. 1–8, and particularly to a putter 10 comprising a head 12 having a shank opening 14 for receiving the shaft 16 (shown in phantom line), which may be secured to the opening 14 in a known manner, e.g., by a suitable adhesive (e.g., epoxy resin). The head 12 has a planar striking face 18 disposed at a loft angle $\phi$ (FIG. 8) from the vertical. The angle $\phi$ is in a range of about 2° and about 4°. The head 12 has a sole or bottom surface 20 which has six planar areas, namely a central planar area 22, intermediate planar areas 24 and 26 outboard of the central area 22, large outboard areas 28 and 30 and trailing area 31. The head 12 has a top surface 32 which is formed with a pair of intermediate recesses 34 and 36. Curved sidewall portions 40 and 42 extend from margins of the face 18 in front of the club and meet at a cusp 46 in the rear of the club, as shown. The side adjacent or proximate the shaft 16 is known as the heel 54 and the distal or remote side is known as the toe 56.

It can be readily appreciated that the head is a single piece construction, in which the bulk of the weight is distributed as hereinafter set forth. The face 18 includes a transverse weighted portion 60 which extends from the heel 54 to the toe 56. A central trailing portion 62 intersects with the transverse weighted portion 60 and extends rearwardly of the club towards the cusp 46. Intermediate recesses 34 and 36 provide lightweight areas in the club and outboard weighted areas 64 and 66 extend from the weighted transverse portions 60 towards the rear of the club, as illustrated. In addition, a central aiming spot 70 may be located in the upper surface 32 near the face 18 generally along a center line of the club and intermediate grooves 68 for aligning and targeting the ball.

The sole or bottom surface 20 of the club has the various beveled surfaces 22–30 formed therein in order to assist the golfer in positioning the club 10 on the green or putting surface. The central area 22 allows the golfer to position the club in a horizontal plane. If, depending upon the golfer's stance, the golfer may hold the club so as to rest the sole 20 on one of the various other putting bevel surfaces including the intermediate surfaces 24 and 26 and the outboard surfaces 28 and 30. As a result, the golfer may adjust stance and grip and yet maintain a comfortable and finely adjusted position of the club. The golfer also enjoys the benefit of a relatively stable reference against which to position the putter. In addition, the trailing surface 31 of the putter provides clearance for the trailing edge on the follow through.

In accordance with the invention, the weight of the putter is predominately concentrated in the center generally CG in alignment with the aiming spot 70 and the grooves 68. The intermediate recessed areas 34 and 36 lighten the club in the regions where putting force is less important and the outboard weighted portions 64 and 66 enlarge the effective useable putter area in the face 18 and balance the club giving outboard stability and resistance to rotation when the ball is struck. The weight distribution of the club allows for a more balanced and optimized distribution of weight which assists the golfer in more accurate putting. Visualization of the proper putting stroke is facilitated by means of the trailing portion 62 and a pair of grooves 68 adjacent lateral margins thereof.

In an exemplary embodiment, the various surfaces 22–30 of the putter lie at an orientation as follows, if surface 22 is considered a horizontal plane, the surface 26 lies at an angle $\rho_1$ of about 2° with respect to 22 of the surface 24. Surface 30 lies at an angle $\rho_2$ of about 4° with respect to surface 22 as does surface 28. Finally, trailing surface 31 lies at an angle $\gamma$ of about 6° with respect to surface 22. The surfaces 22–30 thereby provide a gradual change in the angular position of the club as desired by the golfer in a particular situation. The angles $\rho_1$, $\rho_2$ and $\gamma$ are adjustable for customer implementations.

In the exemplary embodiment, the club itself has an overall width which is in excess of about 4 inches from heel to toe and about 2½ inches from the ball striking face 18 to the extreme or trailing portion of the sidewalls 40 and 42. The large size likewise adds stability and resistance to rotation and yet provides a powerful striking force for a putter.

Figure 8:
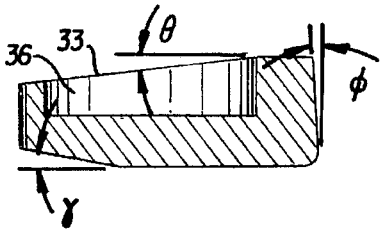
FIG. 8 is a cross-section taken along line 8—8 of FIG. 3.
Figure 4:
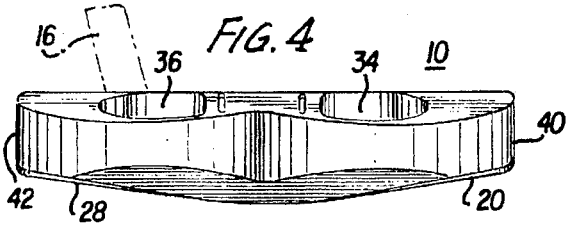
FIG. 4 is a rear elevation of the golf putter.
Figure 5:
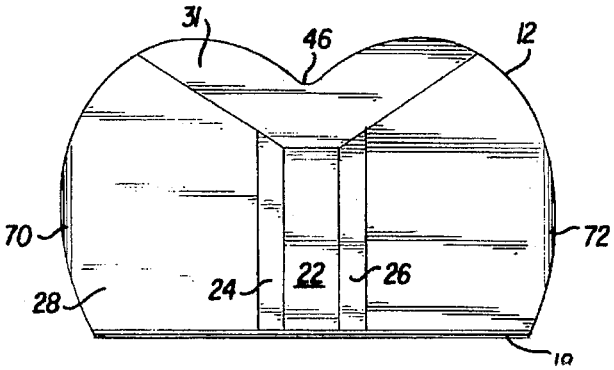
FIG. 5 is a bottom view of the golf putter.
Figure 6:
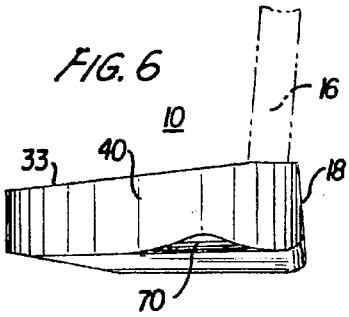
FIG. 6 is a heel side elevation of the golf putter, a toe side elevation being essentially the same.

As can be seen in the side view of FIG. 8, the top surface 32 tapers rearwardly at an angle $\Theta$ of about 5° along a plane 33 towards the rear of the club. Thus, it can be seen that the majority of the weight of the club is concentrated in the transverse area 60 and in particular, in the area centrally of the club between the lateral grooves 68. The outboard margins of the large outboard surfaces 28 and 30 have curved portions 70 and 72 which blend with the respective sidewalls 40 and 42, as shown, for providing lateral clearance during a stroke.

The golf club 10 may be formed of cast aluminum which is thereafter machined to an appropriate finish. Other materials may, of course, be used. The overall weight of the club is in a range of about 250 to about 450 grams. The various dimensions and angles herein discussed may be adjusted for custom applications. Likewise, other weights may be chosen for custom applications.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed:

1. A golf club head comprising: a body having the shape of the letter 'B' including a ball striking face, a sole and outboard heel and toe regions and formed with relatively dense weighted regions and reduced weighted recesses for locating the center of gravity of the club at a selected elevated central location; weighted portions about the center of gravity laterally distribute the weight of the club in gradually increasing amounts outboard of the center of the club; a central weighted portion perpendicular to the club face and aligned with the center of gravity; and a trailing portion for balancing the face of the club around the center of gravity: and means for visualizing the optimum impact point on the face of the club.

2. A golf club putter comprising: a body forming the shape of a 'B' having a heel portion and a toe portion, a striking face extending from the heel portion to the toe portion and a sole; the club having a pair of recesses formed in an upper surface thereof along lateral sides of the center of the club extending rearwardly in a direction perpendicular to the face of the club head; the body having relatively dense weighted regions including a transverse portion in the front along the striking face and an intersecting trailing central portion extending rearwardly of the striking face; lateral body mass being positioned outboard of the recesses and extending rearwardly; the body having an elevated center of gravity located within the central region where the transverse and trailing portions intersect; and a weight distribution such that the club weight decreases in the direction extending transversely and laterally from the center of gravity.

3. The golf club putter of claim 2 wherein a major portion in the mass of the body extends in a lateral direction and is concentrated around the center of gravity above a central horizontal plane of the club.

4. The golf club putter of claim 2 wherein the weight distribution causes the club to resist rotation when striking the ball near the center of gravity.

5. The golf club putter of claim 2 wherein the trailing portion of the club has recesses parallel with a center line of the club for providing visual indication of the location of the center of gravity, so that rotation of the club is minimized when the ball is struck within the inboard boundaries of the lateral recesses.

6. The golf club putter of claim 2 wherein the sole has a plurality of surface portions including a central surface portion, outboard surface portions and intermediate surface portions each smaller than the central and outboard surface portions, said intermediate and outboard portions being at progressively increasing angles from the central portion towards the upper surface.

7. The golf club putter of claim 6 wherein the angles are about 2° and 4° respectively.

8. The golf club of claim 6 wherein the sole has a trailing surface portion lying at an angle relative to the central surface portion towards the upper surface to reduce the trailing weight of the putter.

9. The golf club putter of claim 8 wherein the angle is about 16°.

10. The golf club putter of claim 2 wherein a trailing portion of the body tapers towards the rear of the club to reduce the trailing weight.

11. The golf club putter of claim 10 wherein the taper is about 5°.

12. The golf club putter of claim 2 wherein the club has a weight in a range of about 250 to about 450 grams.

13. The golf putter of claim 2 wherein the recesses have an inboard edge parallel with a center line of the club for providing visual indication of the location of the center of gravity, so that rotation of the club is minimized when the ball is struck within the inboard boundaries of the lateral recesses.

14. The golf putter of claim 2 wherein the trailing portion of the body includes rounded portions converging at a cusp along a center line of the central trailing portion.

15. The golf putter of claim 2 wherein the upper surface of the center trailing portion of the club has symmetrically spaced recesses perpendicular to the face and parallel with the center line through the center of gravity of the club, providing indication of the heaviest weighted areas, as well as an enlarged sweet spot and an indicia in the form of a dot in the upper surface above the center of gravity so that the club operation is maximized when the ball is struck within the inboard boundaries of the lateral recesses and in alignment with the dot.

16. A golf club head comprising: a body having a ball striking face, an upper surface, a continuous sole surface extending to outboard heel and toe regions, said body including relatively dense weighted regions and formed with reduced weighted recesses for locating the center of gravity of the club at a selected elevated central location; the weighted regions include curvelinear portions outboard of the reduced weighted recesses about the center of gravity to laterally distribute the weight of the club head in gradually increasing amounts outboard of the center thereof; the weighted portions of the club head further include an elongated central weighted portion extending between the sole and the upper surface perpendicular to the face and aligned with the center of gravity; a trailing portion of the central weighted portion for balancing the face around the center of gravity and including means in the upper surface for visualizing the optimum impact point on the face.

17. A golf club putter comprising: a body having a heel portion and a toe portion, a ball striking face extending from the heel portion to the toe portion and an upper surface and a continuous lower surface including a sole; the club having a pair of recesses formed in the upper surface thereof along lateral sides of the center of the club extending rearwardly in a direction perpendicular to the face; the body having relatively dense weighted regions of body mass including a transverse portion adjacent the ball striking face and an intersecting trailing central portion extending rearwardly of the ball striking face forming a 'T' shape; and an outboard portion of lateral weights being positioned outboard of the recesses and extending rearwardly and curving laterally outwardly of the trailing central portion; the body having an elevated center of gravity located within the central region where the transverse and trailing portions intersect; and a weight distribution such that the club weight decreases in a direction extending transversely and laterally from the center of gravity.

18. A golf club head having a ball striking face, a continuous sole and outboard heel and toe regions and formed with relatively dense weighted regions and reduced weighted recesses for locating the center of gravity of the club at a selected elevated central location; the weighted regions including weighted portions about the center of gravity to laterally distribute the weight of the club in gradually increasing amounts outboard of the center of the club, a central weighted portion perpendicular to the club face and aligned with the center of gravity, and a trailing portion for balancing the face of the club head around the center of gravity; and means aligned with the center of gravity of the club head for defining the optimum impact point on the face of the club, the club having the shape of a 'B' with a cusp in the trailing portion.

19. A golf club putter comprising: a body having a heel portion and a toe portion, a striking face extending from the heel portion to the toe portion and a sole; the club having a pair of relatively closely spaced recesses formed in an upper surface thereof along lateral sides of the center of the club extending rearwardly in a direction perpendicular to the face; the body having relatively dense weighted regions including a transverse portion in the front along the striking face and an intersecting trailing central portion extending rearwardly of the ball striking face forming a 'T' therewith; lateral body mass being positioned outboard of the recesses and extending rearwardly, forming the shape of a 'B'; the body having an elevated center of gravity located within the central region where the transverse and trailing portions intersect, and a weight distribution such that the club weight decreases in a direction extending transversely and laterally from the center of gravity.

* * * * *